US005826718A

United States Patent [19]

Ahern, Jr. et al.

[11] Patent Number: 5,826,718

[45] Date of Patent: Oct. 27, 1998

[54] TOOL BOX WITH BIN-CARRYING COVER

[75] Inventors: Richard B. Ahern, Jr., Akron; David A. Houk, Jr., Norton; John Travers, Parma, all of Ohio

[73] Assignee: Rubbermaid Incorporated, Wooster, Ohio

[21] Appl. No.: 879,985

[22] Filed: Jun. 20, 1997

[51] Int. Cl.[6] ..... B65D 85/28

[52] U.S. Cl. ..... 206/372; 206/373; 220/521

[58] Field of Search ..... 206/315.11, 372, 206/373, 480; 312/902; 220/521, 522

[56] References Cited

U.S. PATENT DOCUMENTS

| | | | |
|---|---|---|---|
| D. 350,646 | 9/1994 | Bescher et al. | D3/318 |
| D. 352,393 | 11/1994 | Fiore | D3/260 |
| D. 367,360 | 2/1996 | Wolff | D3/323 |
| 4,213,310 | 7/1980 | Buss | 206/544 |
| 4,512,503 | 4/1985 | Gioso | 206/371 |
| 5,176,281 | 1/1993 | Fiore | 220/521 |
| 5,363,956 | 11/1994 | Taniyama | 206/480 |
| 5,386,907 | 2/1995 | Kahl et al. | 206/372 |
| 5,456,368 | 10/1995 | Zehnder | 206/480 |
| 5,507,385 | 4/1996 | Koloski et al. | 206/372 |
| 5,680,932 | 10/1997 | Dickinson et al. | 206/372 |

OTHER PUBLICATIONS

Woodstream (an EKCO Group Company) 1992 Catalog, 2 pages.

Photograph of a product by Curver, 75 Post Bus 6810 4802 HV Breda, The Netherlands (undated).

*Primary Examiner*—David T. Fidei

*Attorney, Agent, or Firm*—Renner, Kenner, Greive, Bobak, Taylor & Weber

[57] ABSTRACT

A container, such as a tool box (10), includes a base portion (11) having an open top and a cover (12) for closing the open top. A plurality of sockets (35) are formed in the cover (12) to receive a bin (13) therein. A bin (13) is maintained in each socket (35) by the interaction of a barb (44) in the socket (35) and a notch (62) in the bin (13), and the interaction of a bump (45) in the socket (36) and a pocket (63) in the bin (13). When in the socket (36) the lid (47) of the bin (13) may be removed therefrom.

23 Claims, 3 Drawing Sheets

TOOL BOX WITH BIN-CARRYING COVER

TECHNICAL FIELD

This invention relates to tool boxes or like containers. More particularly, this invention relates to a tool box having a cover which is configured to selectively carry bins, such as those which may contain small parts, therein.

BACKGROUND ART

Craftsman and other workers often use tool boxes to transport their tools and other work equipment from place to place. Normally, the workman's tool box is filled with the larger equipment that he will need on a daily basis such as hammers, screwdrivers, wrenches, and the like. While smaller items such as screws, washers, nails, nuts, bolts, and the like can be positioned in small compartments in trays often found in tool boxes, usually such trays cannot hold large quantities of such items. Moreover, the presence of such trays limits the amount of larger tools that can be placed in the tool box.

The craftsman often stores large quantities of the smaller parts in bins kept in his workshop, garage or truck. Then, before going to a work site he must either fill his tool box compartments with a quantity of the small parts that he will need to hopefully satisfy the day's requirements, or often he will be forced to carry a number of bins with him so as to be assured that he will have sufficient quantities of all of the necessary small parts.

In the only known prior art tool box which has the capability of carrying such small parts bins integrally therewith, the bins are slidable through the side of and into a compartment formed in the cover. However, when so positioned, the lids on the bins cannot be removed therefrom to gain access to the small parts therein without removing the bins from their compartments.

Thus, the need exists for a tool box which has the capability of carrying small parts bins which can be readily and easily positioned in the cover of the tool box and yet allow the lid of the bin to be readily removed while so positioned.

DISCLOSURE OF THE INVENTION

It is thus an object of the present invention to provide a tool box which has the capability of carrying small parts bins.

It is another object of the present invention to provide a tool box, as above, in which the bins are carried in the cover of the tool box so as not to take up valuable space within the tool box.

It is yet another object of the present invention to provide a tool box, as above, in which the lids of the small parts bins may be removed therefrom while being carried by the cover to gain access to the small parts carried therein.

It is a further object of the present invention to provide a tool box, as above, in which the bins may be selectively removed from the cover and other bins placed therein.

It is a still further object of the present invention to provide a tool box, as above, in which the bins may be easily and quickly snapped through the open top of and into sockets in the cover of the tool box.

It is an additional object of the present invention to provide a tool box, as above, which can be opened with the bins positioned in the cover.

These and other objects of the present invention, as well as the advantages thereof over existing prior art tool boxes, which will become apparent from the description to follow, are accomplished by the improvements hereinafter described and claimed.

In general, a storage container such as a tool box or the like includes a base portion having an open top. A cover closes the open top and has at least one socket formed therein. A bin is inserted into the socket through an upper open access area thereof and is snapped into the socket so that the cover carries the bin.

A preferred exemplary tool box incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
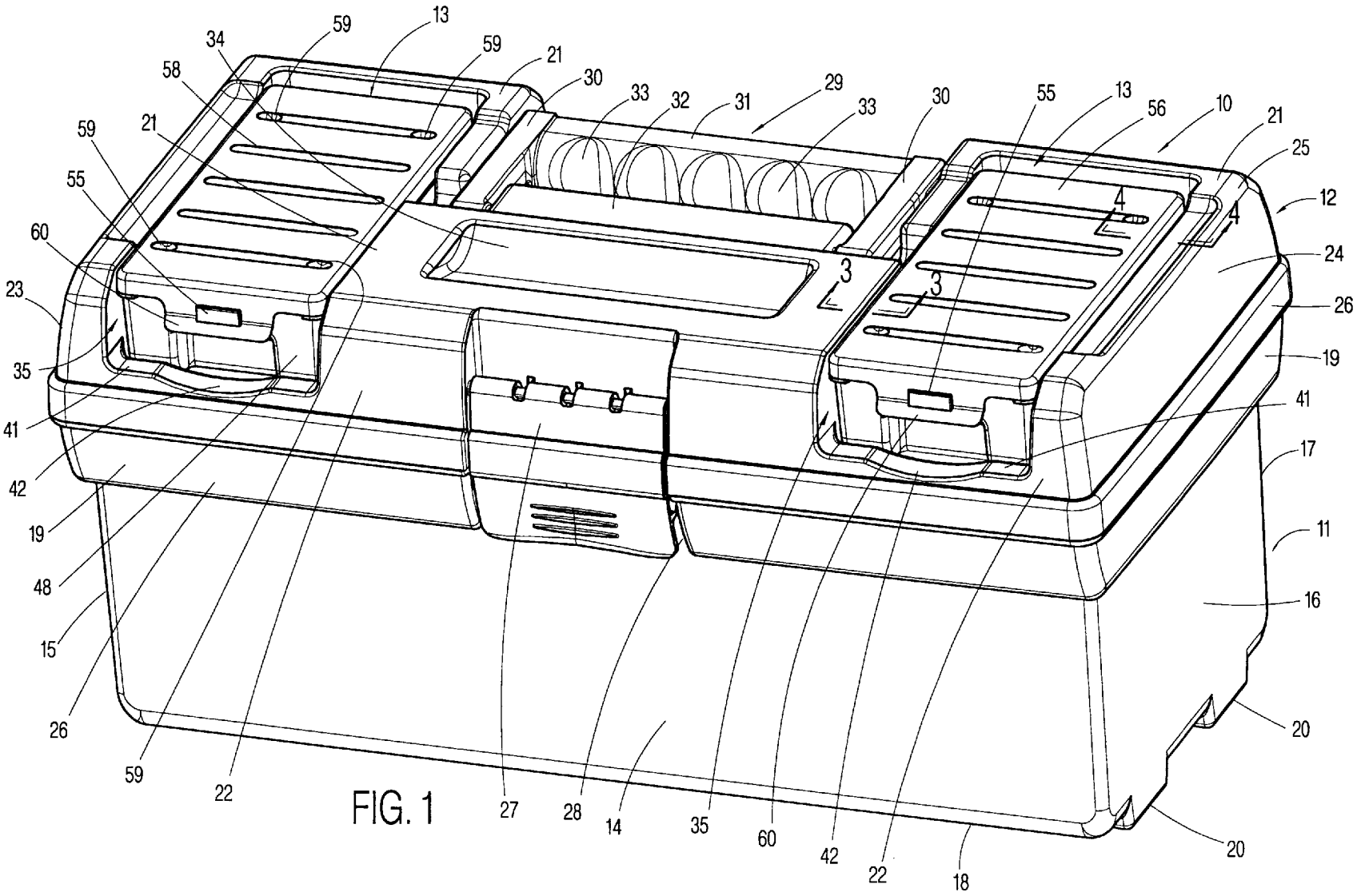
FIG. 1 is a perspective view of a tool box made in accordance with the concepts of the present invention showing two bins positioned in the cover thereof.

A container, such as a tool box, made in accordance with the present invention, is indicated generally by the numeral 10 and includes a base container member, generally indicated by the numeral 11, and a cover, generally indicated by the numeral 12. As will hereinafter be described in detail, tool box 10 also includes one or more bins, generally indicated by the numeral 13, which are selectively carried by cover 12. These components of tool box 10 can be made of any material, but are preferably economically and easily manufactured out of any number of suitable plastics.

Base container 11 can be rectangular in configuration and, as such, includes a front wall 14, side walls 15 and 16, and a rear wall 17. Walls 14, 15, 16, and 17 extend upwardly from a bottom surface 18 to an open top through which materials, such as tools, may be received. An upper peripheral skirt 19 may be formed on walls 14, 15, 16, and 17 around the open top, and bottom surface 18 may be provided with small feet 20, if desired.

Cover 12 includes a top surface 21 with a front wall 22, side walls 23 and 24, and a rear wall 25 extending downwardly therefrom. A lower peripheral skirt 26, generally matching and mating with skirt 19 of base container 11, may be formed around the bottom of walls 22, 23, 24 and 25. While cover 12 may be designed to be totally removable from base container 11, its rear wall 25 is preferably conventionally hingably connected to rear wall 17 of base container 11, and a conventional latch 27 may be provided in a recess 28 formed in cover front wall 22 and skirts 19 and 26 to maintain cover 12 onto base member 11.

In order to conveniently transport tool box 10, a U-shaped handle, generally indicated by the numeral 29, having arms 30 spanned by a grip member 31, may be pivotally carried by a bearing block 32 so that, as shown in FIG. 1, it can be recessed flush with cover top surface 21 when not in use.

Grip member 31 may be provided with notches 33 on the underside thereof for the comfortable placement of the fingers of the user. Cover top surface 21 may also be provided with one or more compartments, such as compartment 34 shown as being formed between latch 27 and handle 29, to receive small parts for ready access.

Cover 12 is also provided with one or more bin-receiving sockets formed therein and generally indicated by the numeral 35. While two sockets 35 are shown, it should be understood that depending on the size of cover 12 and the size of bins 13, any number of sockets 35 could be provided without departing from the concept of the present invention.

Figure 2:
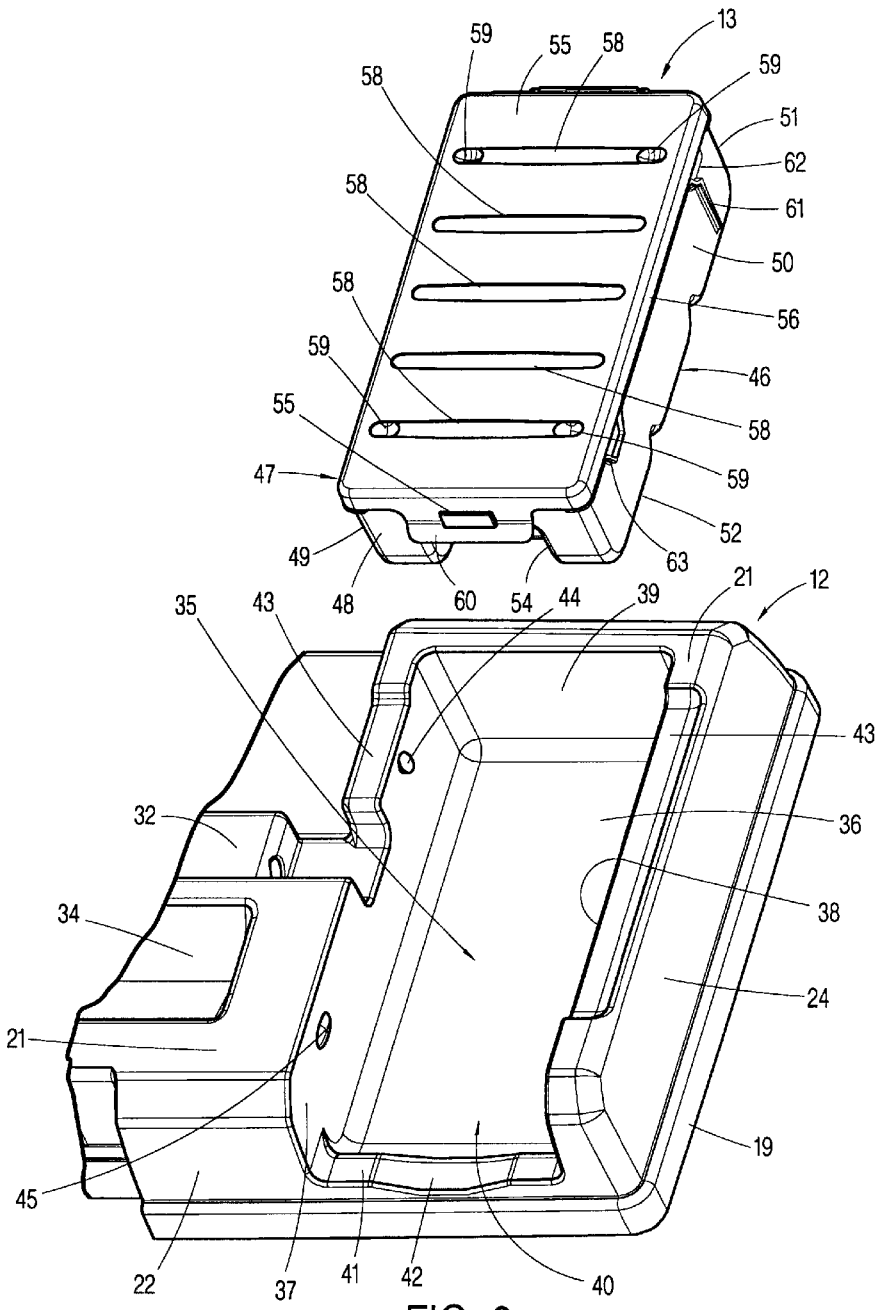
FIG. 2 is a fragmented, exploded perspective view of a portion of the cover of the tool box of FIG. 1 with a bin removed therefrom.
Figure 3:
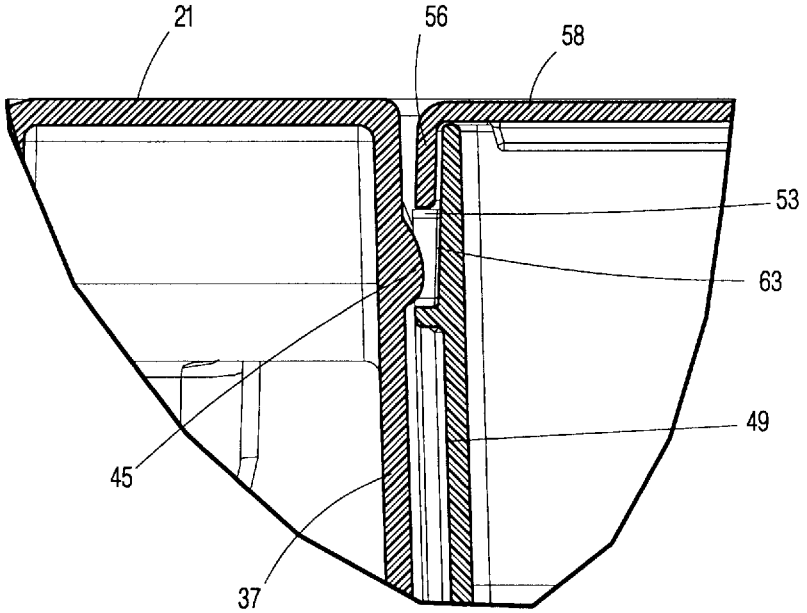
FIG. 3 is a fragmented sectional view taken substantially along line 3—3 of FIG. 1.
Figure 4:
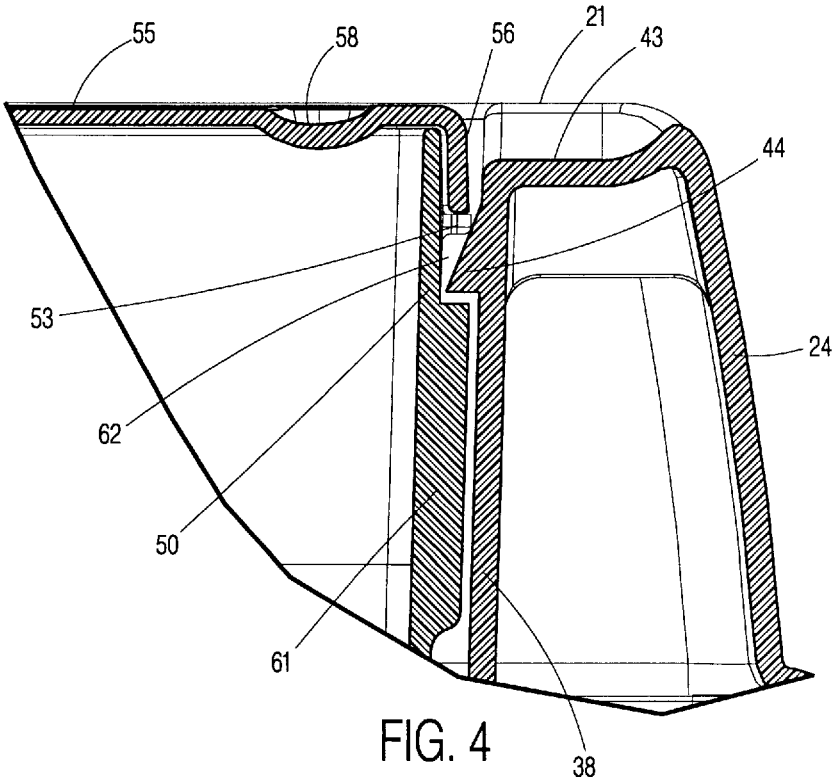
FIG. 4 is a fragmented sectional view taken substantially along line 4—4 of FIG. 1.

The configuration of each socket 35 is best shown with reference to FIGS. 2–4. Each socket 35 includes a bottom surface 26 having side walls 37 and 38, and a back wall 39 extending upwardly therefrom forming an open top area in cover top surface 21 which establishes top access to socket 35. An opening 40 in front wall 22 of cover 12 provides front access to socket 35. Opening 40 is defined by socket side walls 37 and 38 and a lower ledge 41 which may be dished out slightly, as at 42, for easy finger access to a bin 14 positioned in a socket 35. Areas of cover top surface 21 around the periphery of sockets 35 may also be dished out, such as at 43, so that the feet 20 of a like base tool box 10 can be stably positioned thereon in order to stack like tool boxes for storage, shipping, or retail display. It should also be appreciated that access opening 40 need not be positioned in the front wall 22 of cover 12. Rather, such could be provided in side walls 23 and 24 thereof or even through rear wall 25 depending on the overall dimensions of tool box 10 and its associated bins 13.

Socket side walls 37 and 38 are each provided with an angled barb 44 extending into socket 35 near the top thereof and near back wall 39. Similarly, socket side walls 37 and 38 are also each provided with lock bumps 45 extending into socket 35 near the top thereof and near access opening 40. Snap barbs 44 are preferably opposite to each other and at the same height on socket side walls 37 and 38 as lock bump 45, which are likewise opposite to each other. As will hereinafter be described, barbs 44 and bumps 45 function with complimentary members on bins 13 to allow a bin 13 to be snapped into and thereby held in a socket 35.

Each bin 13 includes a base member generally indicated by the numeral 46 and a lid, generally indicated by the numeral 47 and received on base member 46. Base member 46 and socket 35 are complementarily configured so that bin 13 may be received in socket 35. As such, base member 46 includes a front wall 48, side walls 49 and 50, and a rear wall 51 all extending upwardly from a bottom surface 52 and forming an open top to be closed by lid 47. A peripheral rim 53 (FIGS. 3 and 4) extends around walls 48, 49, 50 and 51 just below the top thereof. Bottom surface 52 may be provided with small feet (not shown), and front wall 48 has a recess 54 therein and a snap bar 55 positioned above recess 54.

Lid 47 includes a top surface 56 and a peripheral skirt extending downwardly therefrom. Skirt 57 rests on rim 53 of base member 46 when lid 47 is closed thereon. Top surface 56 may be provided with a plurality of small grooves 58 therein which can provide structural support or rigidity to top surface 56. The forward most and rearward most grooves 58 may be provided with depressions 59 at their outer ends which serve as locators for the feet of a like bin 13. Thus, bins 13 may be readily and stably stacked for storage purposes.

A lip 60 extends downwardly from skirt 57 of lid 47, and when lid 47 is placed on base member 46, lip 60 is intended to be adjacent to recess 54 in front wall 48 of base member 46. Lip 60 has a slot therein through which snap bar 55 may be snapped. As such, bin lid 47 is maintained on its base member 46, but by lifting lip 60, lid 47 may be removed from base member 46 for access to the parts stored therein.

Each side wall 49 and 50 of bin base member 46 has a generally vertical rib 61 extending outwardly therefrom thereby forming a notch 62 at the top of rib 61 at a point where rim 53 is interrupted. Such ribs 61 and notches 62 are formed near back wall 51. A pocket 63 is formed on each side wall 49 and 50 near front wall 48. Notches 62 are preferably opposite to each other and at the same height on side walls 49 and 59 as pockets 63 which are likewise opposite to each other. Rib 61, notches 62, and pockets 63 function in a complimentary manner with barbs 44 and bumps 45 in sockets 35 to hold a bin 13 therein, as now will be described.

A bin 13 may be easily positioned in a socket 35 by grasping bin 13 near the front thereof and positioning it at an angle such that the rear thereof is lower than the front. Then bin 13 may enter socket 35 through the top access opening therein and by positioning snap barbs 44 in notches 62 and rotating bin 13 downwardly at the front thereof, bumps 45 snap into pockets 63, all of which is shown in FIGS. 3 and 4. As such, bin 13 is securely held in socket 35 and will stay therein even if cover 12 is rotated on its hinges to open tool box 10. Moreover, when bins 13 are positioned in sockets 35, their lids 47 may be removed therefrom for access to the parts therein without having to remove a bin 13 from its socket 35. To remove a bin 13 from a socket 35, one merely needs to lift the front end thereof to disengage bumps 45 from pockets 63, with continued lifting, and slight pulling, thereafter disengaging barbs 44 from notches 62.

From the foregoing it should be evident that the craftsman, on a periodic basis, may maintain a large plurality of bins 13, full of selected small parts, at his workshop or the like, and on a periodic basis, select from those bins 13 those which he may need to perform his daily tasks, and position them in his tool box 10. As such, the objects of the present invention are accomplished thereby substantially improving the tool box art.

We claim:

1. A storage container comprising a base portion having an open top, a cover for closing the open top, at least one socket formed in said cover and having an upper open access area, and a bin being snapped into said socket by passing said bin downwardly through said access area so that said cover engages said bin.

2. A storage container according to claim 1 further comprising complimentary means in said socket and on said bin to maintain said bin in said socket.

3. A storage container according to claim 2 wherein said complimentary means includes barbs formed in said socket and notches on said bin, said barbs being received in said notches.

4. A storage container according to claim 2 wherein said complimentary means includes bumps formed in said socket and pockets formed in said bin, said bumps being received in said pockets.

5. A storage container according to claim 4 wherein said complimentary means includes barbs formed in said socket and notches on said bin, said barbs being received in said notches.

6. A storage container according to claim 5 wherein ribs on said bin form said notches.

7. A storage container according to claim 1 wherein said socket is open at the top and includes at least two walls separated by an access opening, and said bin includes side walls positioned adjacent to said two walls.

8. A storage container according to claim 7 further comprising a barb formed on each of said two walls, and a notch formed in each of said side walls, said barbs being received in said notches to maintain said bin in said socket.

9. A storage container according to claim 8 further comprising a bump formed on each of said two walls near said access opening, and a pocket formed in each of said side walls, said bumps being received in said pockets to maintain said bin in said socket.

10. A storage container according to claim 1, said cover having a top surface and further comprising feet on said base member, and means on said top surface to receive the feet of a like container.

11. A storage container according to claim 1, said bin including a base member having an open top and a lid to close the open top.

12. A storage container according to claim 11 wherein said lid may be removed from said base member while said bin is in said socket.

13. A storage container according to claim 11 further comprising a snap bar on said base member and a lip on said lid, said snap bar being received through said lip to maintain said lid on said base member.

14. A storage container according to claim 11 further comprising depressions in said lid to locate a like bin thereon.

15. In combination, a storage container and a storage bin, the storage container including a base portion having an open top and a cover for closing the open top, said cover having at least one socket formed therein, said socket having an upper open access area, said socket and the storage bin being complementarily configured so that by inserting the storage bin downwardly through said access area said bin may be snapped into and securely held in said socket.

16. The combination of claim 15 further comprising complimentary means in said socket and on the storage bin to maintain the storage bin in said socket.

17. The combination of claim 15 wherein said socket is open at the top and includes at least two walls separated by an access opening, and the storage bin includes side walls positioned adjacent to said two walls.

18. The combination of claim 17 further comprising a barb formed on each of said two walls, and a notch formed in each of said side walls, said barbs being received in said notches to maintain the storage bin in said socket.

19. The combination of claim 18 wherein ribs on the storage bin form said notches.

20. The combination of claim 18 further comprising a bump formed on each of said two walls near said access opening, and a pocket formed in each of said side walls, said bumps being received in said pockets to maintain the storage bin in said socket.

21. The combination of claim 15 wherein the bin includes a base member having an open top and a lid to close the open top, said lid being removable from said base member when the bin is in said socket.

22. A storage container comprising a base portion having an open top, a cover for closing the open top, at least one socket formed in said cover, and a bin receivable in said socket, said bin having a base member with an open top and a lid to close the open top, said lid being removable from said base member when said bin is in said socket.

23. A storage container comprising a base portion having an open top, a cover for closing the open top, at least one socket formed in said cover and having an upper open access area, barbs formed in said socket, a bin, and ribs on said bin forming notches, said bin being snapped into said socket through said access area whereby said barbs are received in said notches so that said cover carries said bin.

* * * * *